US011883715B1

(12) United States Patent
Howard et al.

(10) Patent No.: US 11,883,715 B1
(45) Date of Patent: Jan. 30, 2024

(54) EXERCISE PLATFORM WITH HEIGHT-ADJUSTABLE SUPPORT BLOCK

(71) Applicants: Phillip Andrew Howard, Northumberland, PA (US); Christopher Harold Arbogast, Danville, PA (US); Eric Nicholas Attinger, Sunbury, PA (US)

(72) Inventors: Phillip Andrew Howard, Northumberland, PA (US); Christopher Harold Arbogast, Danville, PA (US); Eric Nicholas Attinger, Sunbury, PA (US)

( * ) Notice: Subject to any disclaimer, the term of this patent is extended or adjusted under 35 U.S.C. 154(b) by 0 days.

(21) Appl. No.: 17/548,811

(22) Filed: Dec. 13, 2021

(51) Int. Cl.
*A63B 23/04* (2006.01)
*A63B 21/00* (2006.01)

(52) U.S. Cl.
CPC ..... *A63B 23/0405* (2013.01); *A63B 21/4037* (2015.10); *A63B 2023/0411* (2013.01)

(58) Field of Classification Search
CPC ..... A63B 23/0405; A63B 21/4037; A63B 2023/0411; A63B 23/00; A63B 23/10; A63B 23/04; A63B 23/035; A63B 23/08; A63B 23/085; A63B 23/0458; A63B 2023/006; A63B 21/4029; A63B 21/00047; A63B 21/00; A63B 21/068; A63B 21/06
See application file for complete search history.

(56) References Cited

U.S. PATENT DOCUMENTS

| | | | | |
|---|---|---|---|---|
| 1,623,671 A | | 4/1927 | Leo | |
| 3,297,320 A | | 1/1967 | Di Benedetto | |
| 3,598,404 A | | 8/1971 | Bowman | |
| 3,741,540 A | | 6/1973 | Shimizu | |
| 4,253,661 A | | 3/1981 | Russell | |
| 4,358,106 A | | 11/1982 | Shadford | |
| 4,441,758 A | | 4/1984 | Fleischer et al. | |
| 4,678,234 A | | 7/1987 | Wilson | |
| 4,693,470 A | | 9/1987 | Ogawa | |
| 4,917,385 A | * | 4/1990 | Brown | A63B 69/3667 473/273 |
| 5,000,457 A | * | 3/1991 | Brown | A63B 69/3667 473/273 |
| 5,050,861 A | | 9/1991 | Thomas et al. | |
| 5,066,001 A | * | 11/1991 | Wilkinson | A63B 21/4037 482/52 |

(Continued)

FOREIGN PATENT DOCUMENTS

| | | | |
|---|---|---|---|
| WO | 2016027109 | A1 | 2/2016 |
| WO | 2021081458 | A1 | 4/2021 |

*Primary Examiner* — Garrett K Atkinson
(74) *Attorney, Agent, or Firm* — Gerben Perrott, PLLC; Benjamin M. Hanrahan

(57) ABSTRACT

An exercise assembly for assisting a user in performing squats and other exercise maneuvers is presented herein. The exercise assembly includes a substantially planar base platform, at least one riser bracket fixed to a top surface of the base platform, and a plurality of risers each selectively and removably disposable in a vertically stacked orientation within a channel of the at least one riser bracket to define a height-adjustable support block. Selective removal of one or more of the risers from the vertically stacked orientation within the channel will serve to lower the height-adjustable support block for the performance of more challenging squat exercises.

17 Claims, 7 Drawing Sheets

(56) References Cited

U.S. PATENT DOCUMENTS 5,087,036 A * 2/1992 Cooper ..... A63B 23/085 482/79
5,116,045 A 5/1992 Jahoda
5,154,678 A * 10/1992 Adamczyk ..... A63B 23/0458 482/52
5,184,987 A * 2/1993 Wilkinson ..... A63B 23/0458 482/52
5,275,579 A * 1/1994 Wilkinson ..... A47C 3/20 482/52
5,284,465 A 2/1994 Homan, Jr.
5,322,490 A * 6/1994 Van Der Hoeven ..... A63B 69/0022 482/52
5,326,338 A 7/1994 Makous
5,354,247 A 10/1994 Wilkinson
5,357,876 A 10/1994 Kniefel et al.
5,387,166 A * 2/1995 Gvoich ..... A63B 21/4029 482/52
5,474,509 A * 12/1995 Hodgdon ..... A63B 23/0458 482/52
5,529,558 A 6/1996 Koenig
5,591,105 A * 1/1997 Dalebout ..... A63B 23/0458 482/52
5,669,089 A * 9/1997 Dees ..... B25H 5/00 5/722
5,672,144 A * 9/1997 Hulme ..... A63B 23/0211 482/91
5,772,559 A * 6/1998 Sithole ..... A63B 23/0458 482/52
5,950,260 A * 9/1999 Dees ..... B25H 5/00 5/419
6,063,007 A 5/2000 Sithole
6,238,320 B1 * 5/2001 Flanagan ..... A63B 3/00 482/130
6,290,628 B1 * 9/2001 Wilkinson ..... A47C 3/20 482/52
7,036,162 B1 * 5/2006 Gatten ..... A47C 27/085 5/655.5
7,645,221 B1 1/2010 Curry
7,824,319 B2 * 11/2010 Carlesimo ..... A63B 26/00 482/141
7,922,623 B2 * 4/2011 Flentye ..... A63B 23/0458 482/52
7,922,624 B1 4/2011 Fairhurst et al.
8,348,812 B2 * 1/2013 Elpers ..... A63B 23/04 482/52
8,915,825 B2 * 12/2014 Elpers ..... A63B 23/04 482/52
9,192,867 B1 * 11/2015 Sann ..... A63B 1/00
9,211,437 B2 12/2015 Soba
9,415,260 B2 * 8/2016 Islas ..... A63B 21/4034
9,433,813 B1 9/2016 Cervantez
9,789,346 B1 10/2017 Kime
10,045,647 B2 * 8/2018 Publicover ..... A63B 21/023
10,252,103 B2 * 4/2019 Irwin ..... B32B 3/30
10,406,395 B2 9/2019 Haas
10,549,142 B1 2/2020 Ash
11,172,775 B2 * 11/2021 Publicover ..... A63B 21/0442
2002/0177509 A1 * 11/2002 Rodgers ..... A63B 23/0458 482/53
2004/0082441 A1 4/2004 Kastelic
2005/0192158 A1 * 9/2005 Edwards ..... A63B 6/00 482/148
2006/0189448 A1 * 8/2006 Flentye ..... A63B 23/0458 482/52
2006/0189449 A1 8/2006 Flentye et al.
2008/0118671 A1 5/2008 Bienkiewicz
2009/0111669 A1 4/2009 Richter
2009/0124464 A1 * 5/2009 Kastelic ..... A63B 23/0458 482/52
2009/0247378 A1 * 10/2009 Carlesimo ..... A63B 26/00 482/141
2011/0207583 A1 * 8/2011 Elpers ..... A63B 23/0458 482/52
2012/0115692 A1 5/2012 Bussen et al.
2012/0316044 A1 * 12/2012 Matsuno ..... A63B 23/0458 482/142
2013/0017372 A1 * 1/2013 Mechling ..... A63B 6/00 428/192
2013/0045840 A2 2/2013 Ross
2013/0090216 A1 * 4/2013 Jackson ..... A63B 21/0442 482/52
2013/0217545 A1 * 8/2013 Orenstein ..... A63B 23/0458 482/52
2013/0324382 A1 12/2013 Wilson
2014/0031183 A1 1/2014 Blake
2014/0051553 A1 * 2/2014 Hetzel ..... A63B 21/0004 482/52
2014/0187386 A1 * 7/2014 Elpers ..... A63B 23/0458 482/52
2014/0221182 A1 * 8/2014 Lin ..... A63B 23/03525 482/142
2016/0199689 A1 * 7/2016 Irwin ..... B32B 21/047 482/142
2016/0199690 A1 * 7/2016 Islas ..... A63B 21/00047 482/79
2017/0172331 A1 * 6/2017 Publicover ..... B32B 7/022
2018/0028853 A1 2/2018 Cargill
2018/0071575 A1 * 3/2018 Crass ..... A63B 6/00
2018/0360250 A1 * 12/2018 Publicover ..... A63B 23/10
2019/0262658 A1 8/2019 Salamone

* cited by examiner

EXERCISE PLATFORM WITH HEIGHT-ADJUSTABLE SUPPORT BLOCK

FIELD OF THE INVENTION

The present invention is generally directed to an exercise assembly, and more specifically, to an exercise and/or therapy platform that includes a height-adjustable support block disposed on a top surface thereof that can support a user's heel during a squat or other like exercise

BACKGROUND OF THE INVENTION

It is widely known and accepted that regular exercise is an important aspect of a healthy lifestyle. While there are a number of different routines and techniques that an individual can include within a regular exercise regimen, squats are considered by many to be a vital exercise for increasing the strength and size of the lower body as well as for improving core strength, and other various muscles and joints. For instance, when performed correctly, squats can, among other various benefits, help build muscle, burn calories, improve flexibility and mobility, and help maintain and improve joints, including the hip, knees and ankles.

More specifically, a squat is defined as a strength exercise in which the user or individual lowers his/her hips from an initial standing position, and then stands back up, generally without moving the feet throughout the exercise or maneuver. In many cases, the feet are spaced laterally apart from one another throughout the entire squat exercise such as approximately shoulder width apart, however, other distances wider or narrower can be used. The hip and knee joints flex during the decent of the squat and extend during the ascent.

Furthermore, a flat-footed or primal squat is accomplished when the user or individual performs a squat, as described above, while his/her feet remain flat or are otherwise pressed down upon a flat surface during the entire maneuver. In other words, during a flat-footed or primal squat the balls of the feet (i.e., the portion of the foot where the toes attach to the foot) are level with the heels of the feet during the entire squat exercise.

However, flat-footed or primal squats may be considered more difficult to perform than squats with the heels raised above the balls of the feet, particularly for individuals who may be a beginner or on an intermediate level.

Accordingly, there is a need in the art for an exercise or therapy device that can be used to help individuals begin with a raised squat (e.g., with the heels raised higher than the balls of the feet), and then progressively and measurably squat deeper by lowering the heel position until eventually the heel is flat and a flat-footed or primal squat can be performed.

SUMMARY OF THE INVENTION

Accordingly, the present invention is generally directed to an exercise assembly, and more specifically, to an exercise and/or therapy platform that includes a height-adjustable support block disposed on a top surface thereof that can support a user's heel during a squat or other like exercise. The exercise or therapy device, of the various embodiments disclosed herein, can be used to help individuals begin with a raised squat (e.g., with the heels raised higher than the balls of the feet), and then progressively and measurably squat deeper by lowering the heel position until eventually the heel is flat and a flat-footed or primal squat can be performed.

In particular, the exercise or therapy assembly of at least one embodiment of the present invention includes a generally flat base or platform with at least one riser bracket secured or fixed to a top surface thereof, for example, across a top surface at or near a rear edge. A plurality of risers or planks sized to fit within the riser bracket(s) can be selectively or removably disposed therein to define a height-adjustable support block, for example, for the user's heel.

The base or platform, itself, as well as the riser bracket(s), can be made in different shapes and sizes and can be made out of different rigid, semi-rigid or soft materials, such as wood, metal, plastic, foam, etc., and can have non-slip surfaces for purposes of safety and security. The risers or planks can also be made out of different rigid, semi-rigid or soft materials, such as wood, metal, plastic, foam, etc. and can also have non-slip surfaces for purposes of safety and security. In addition, the risers or planks of at least one embodiment have a corresponding length and/or width so as to removably fit within the riser bracket(s), and in particular, within a channel defined by two opposing U-shaped riser brackets. In some cases, however, the plurality risers or planks of a particular assembly may have different thicknesses. This allows the user to more accurately customize the height of the vertically stacked risers or height-adjustable block, for example, by choosing which riser(s) or plank(s) to stack within the riser bracket(s) and/or the channel defined thereby.

More specifically, the risers or planks can be vertically stacked within the riser brackets and/or channel thereof in order to define or create the height-adjustable support block. In many embodiments, the risers or planks can be stacked in any order or orientation, meaning that any of the risers or planks can be vertically stacked upon any one or more of the other risers or planks, as desired or as customized by the particular user.

In this manner, the exercise or therapy assembly of the present invention will assist users who are unable to (at least initially) perform a flat-footed or primal squat, reach their goal of doing so. More specifically, the exercise assembly allows the user to start with a raised heel equal to the height of the height-adjustable support block as chosen by that particular user—for example, by allowing the user to vertically stack as many risers, and which particular risers, as desired to define a user-customized support block. The user can then perform as many squats as he/she desires with the heel raised and supported upon the user-customized height-adjustable support block. The user can then progressively remove one or more risers or planks from the vertical stack or support block to lower the height thereof, with the ultimate goal of reaching a flat-footed or primal squat.

In some embodiments, a second set of brackets and/or storage brackets may also be included and fixed to the top surface of the platform. In such a manner, risers or planks that are not being used (e.g., those that have been removed from the riser bracket to lower the height-adjustable support block) may be temporarily and removably stored in the storage bracket(s). Additionally, the risers or planks may be stored in the storage bracket(s) during transportation and/or storage of the assembly, and thus, in some cases, a securing device such as a strap may also be included to removably secured the risers or planks therein.

It should be noted and apparent that the exercise assembly of the various embodiments disclosed herein can be vital to strengthening the user's ankles, knees, hips, and lower back, as well as allowing the user to better improve his/her flexibility and range of motion. In this manner, the assembly can be used in a variety of different locations, such as at home, in a gym, at a physical therapy establishment, etc., and can therefore assist the development of numerous fields, including, but not limited to physical therapy, sports therapy, rehabilitation, personal training, personal health and fitness, etc.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1:
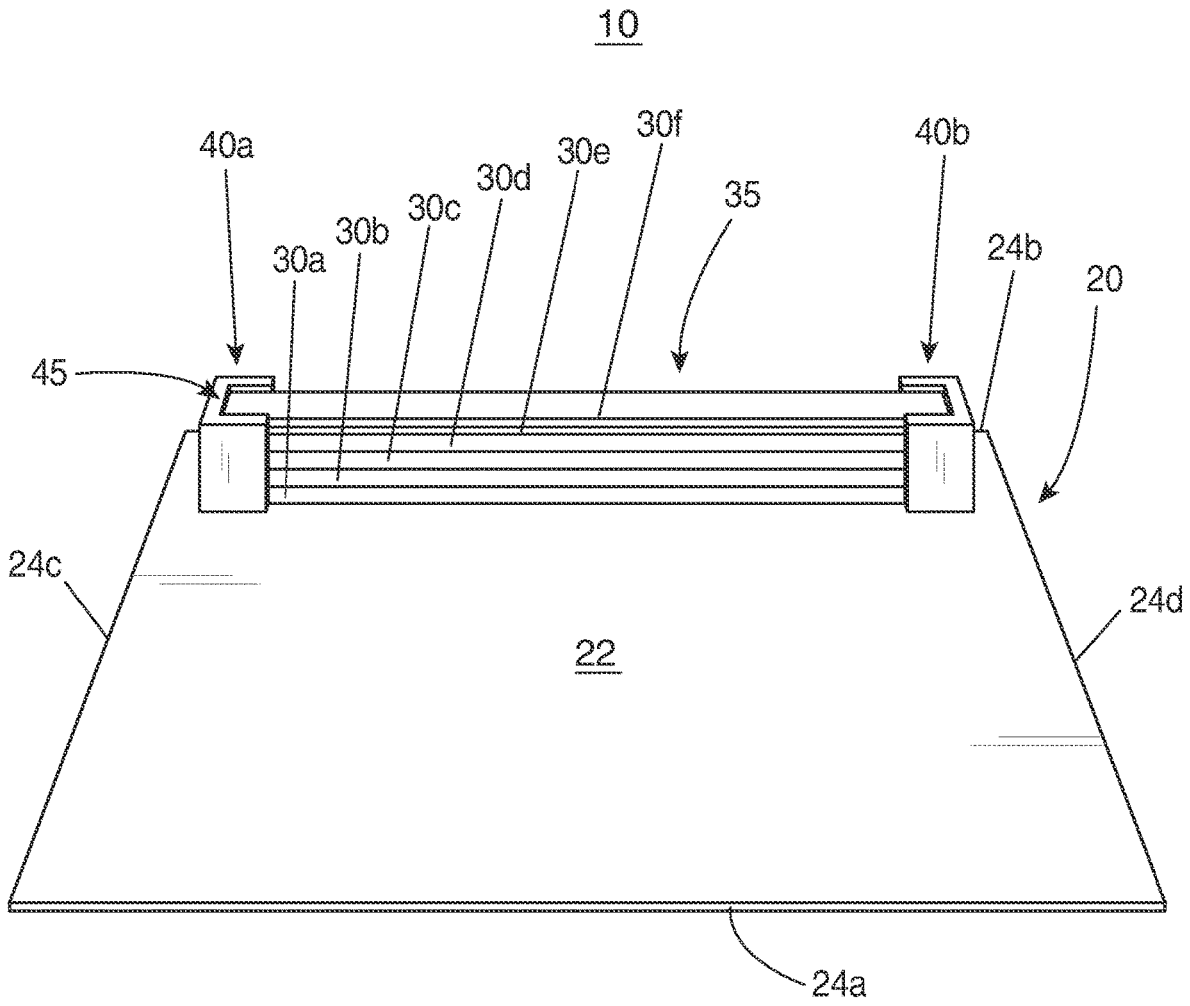
FIG. 1 is a front perspective view of the exercise assembly as disclosed in accordance with at least one embodiment of the present invention.
Figure 2:
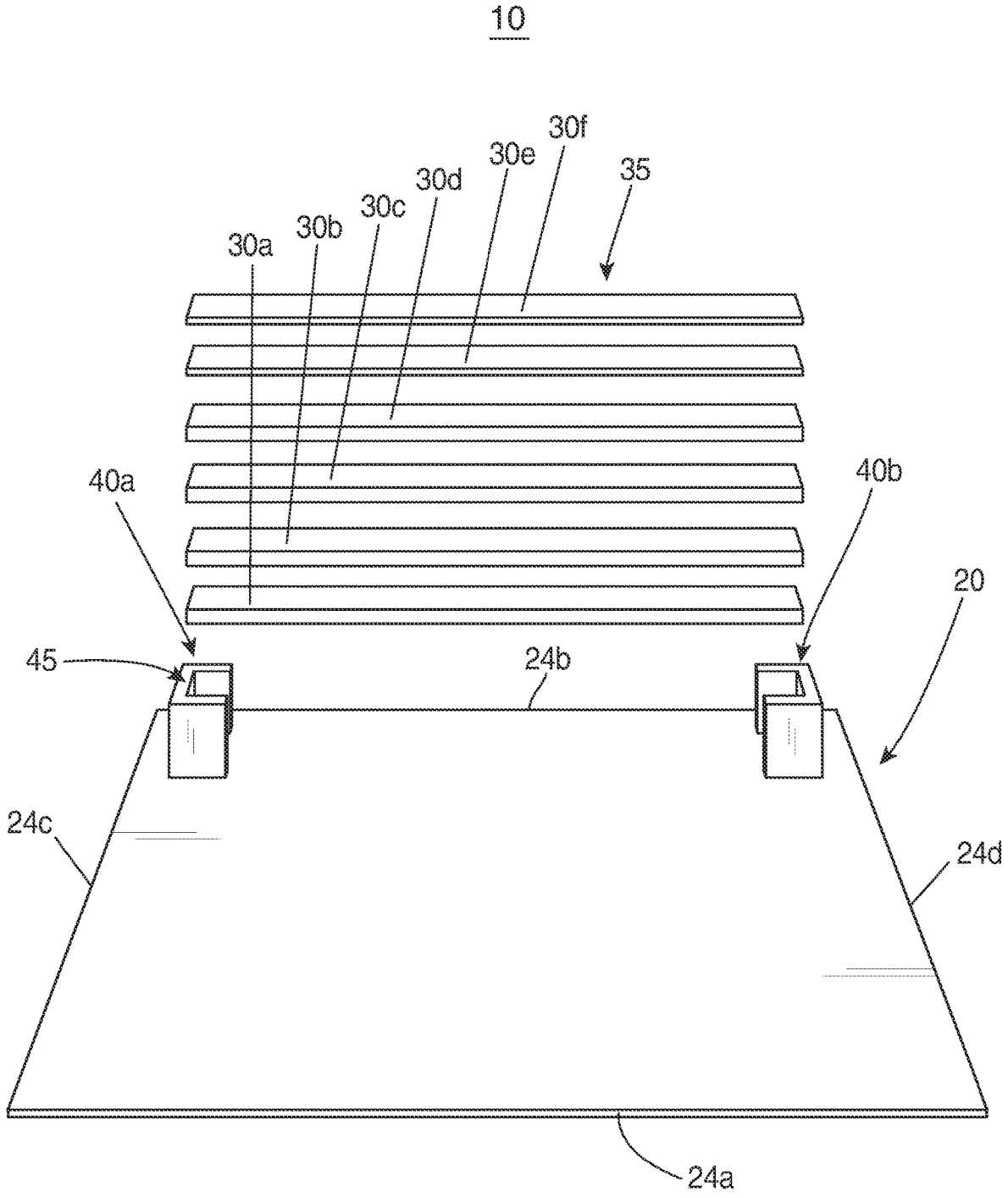
FIG. 2 is a front perspective and at least partially exploded view illustrating the several risers of the exercise assembly as disclosed in at least one embodiment herein.
Figure 3:
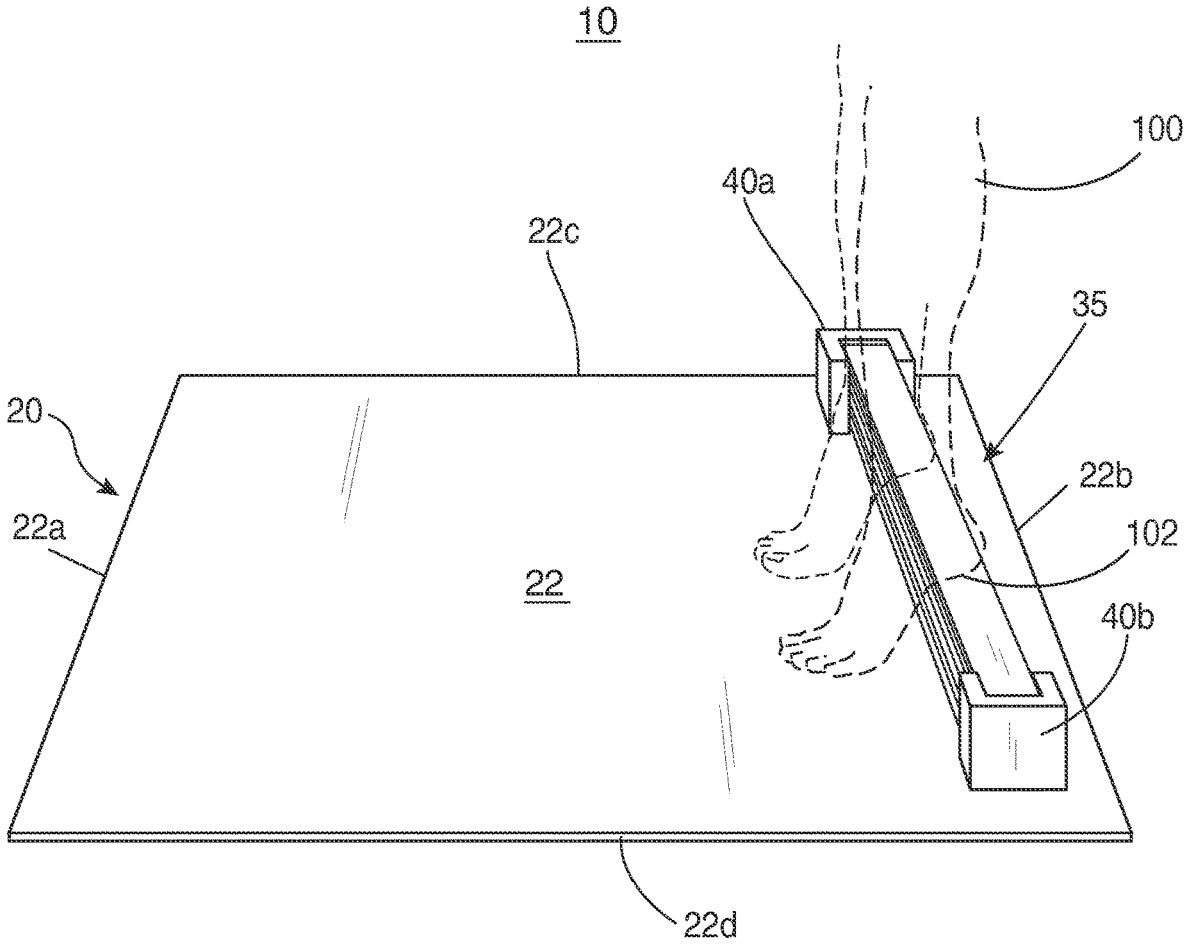
FIG. 3 is a right-side perspective view of the exercise assembly as disclosed in accordance with at least one embodiment of the present invention.
Figure 4:
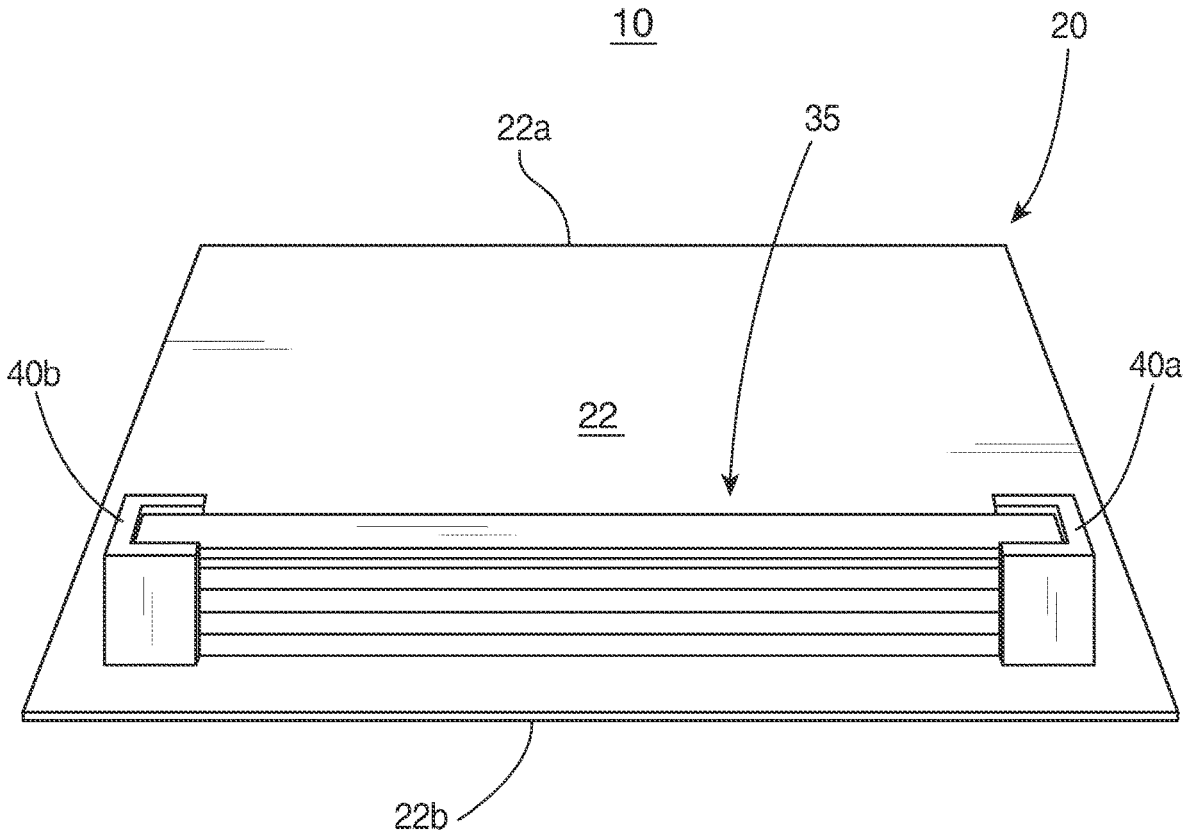
FIG. 4 is a rear perspective view of the exercise assembly as disclosed in accordance with at least one embodiment of the present invention.

As shown in the accompanying drawings, and with particular reference to FIGS. 1 and 2, the present invention is directed to an activity or exercise assembly, generally referenced as 10, which allows a user to perform one or more exercises or activities, including but in no way limited to squats. More specifically, a squat is defined as a strength exercise in which the user or individual lowers his/her hips from an initial standing position, and then stands back up, generally without moving the feet throughout the exercise or maneuver. It should be noted that the activity or exercise assembly 10 of the present invention is described as being used to perform the squat exercise or maneuver, however, other exercises, activities or maneuvers, in addition to or instead of squats, can be performed using the assembly 10 of the various embodiments of the present invention.

More specifically, the activity assembly or exercise assembly 10 of at least one embodiment of the present invention includes a base 20 which can, in some embodiments, be defined as a platform upon which a user or individual can stand during operation of the present invention or otherwise, while performing an exercise, activity or maneuver as described herein. In this manner, the base 20 of at least one embodiment includes or otherwise defines a top surface 22 that is flat or planar, or is substantially flat or planar, upon which a user or individual may stand. As will be described herein, it should be noted that in some embodiments, one or more of the outer edges of the base 20 or platform may be tapered, angled or curved, for example, toward the floor or ground.

Moreover, still referring to FIGS. 1 and 2, the base 20 or platform of at least one embodiment of the present invention, or otherwise, the top surface 22 thereof, may form a polygon or virtually any shape, including, but in no way limited to a square, rectangle, rhombus, triangle, pentagon, hexagon, octagon, etc. In the embodiment shown, the base 20 or platform includes a rectangular shape defining a front edge 24*a* and an oppositely disposed rear edge 24*b*. Opposing side edges 24*c* and 24*d* are also illustrated in this exemplary embodiment.

In any event, the base 20 or platform of at least one embodiment is constructed of a rigid, semi-rigid or soft, resilient material, including, but in no way limited to wood, plastic, metal, foam, etc., in order to facilitate implementation of the present invention in the intended manner.

Furthermore, the activity or exercise assembly 10 of at least one embodiment of the present invention includes a plurality of risers represented as 30*a*-30*f*, which collectively form or define a height-adjustable support block 35. As shown in the embodiment of FIGS. 1 and 2, the height-adjustable support block 35 is formed or disposed on the top surface 22 of the base 20.

More specifically, in at least one embodiment, at least one riser bracket 40*a*, 40*b* is attached, and in some embodiments, fixedly attached, to the top surface 22 of the base 20. The riser bracket(s) 40*a*, 40*b* define a channel 45 or space there between within which the one or more risers 30*a*-30*f* are selectively and removably disposed, as described herein.

More in particular, in at least one embodiment, the assembly 10 includes two opposing riser brackets, such as a first riser bracket 40*a* and a second riser bracket 40*b*, which collectively define the channel 45 there between. In this manner, the first and second riser brackets 40*a*, 40*b* of at least one embodiment are attached or fixed to the base 20 in a spaced apart manner and each include a U-shaped configuration which define the corresponding ends of the channel 45. For instance, open ends of the U-shaped brackets 40*a*, 40*b* are aligned with one another in a spaced and facing relation to define the ends of channel 45, which spans to and between the opposing U-shaped brackets 40*a*, 40*b*.

Moreover, the riser brackets 40*a*, 40*b* are spaced in a manner such that the channel 45 includes a length that allows the risers 30*a*-30*f* to be disposed therein in a secure, yet removable manner. For instance, the length of the channel 45 defined by the riser brackets 40*a*, 40*b* may be equal to or slightly longer than the length of each corresponding riser 30*a*-30*f*, thereby allowing the risers 30*a*-30*f* to be removably stacked therein, as shown in exemplary FIGS. 1 and 2.

It should be noted that the channel 45 defined by the riser brackets 40*a*, 40*b* of a least one embodiment includes an elongated shape or configuration in that the length of the channel 45 is longer than the width of the channel 45, however, other shapes and sizes are contemplated within the full spirit and scope of the various embodiments disclosed herein. Accordingly, the various risers 30*a*-30*f* of at least one embodiment include a shape and size that is consistent with or otherwise compatible with the shape of the channel 45 thereby allowing the risers 30*a*-30*f* to be removably disposed therein. In other words, in the embodiment shown with an elongated channel 45, the risers 30*a*-30*f* also include a similar or corresponding elongated configuration.

It should also be noted that, in at least one embodiment, the riser bracket(s) 40*a*, 40*b* include an open top face which allows the one or more risers 30*a*-30*f* to be lowered into the channel 45 and stacked therein, as shown and described. Other configurations, shapes and constructions of the bracket(s) 40*a*, 40*b* to define a corresponding channel 45 are contemplated herein and are within the full spirit and scope of the present invention. As just an example, a single riser bracket may be formed and secured to the top surface of the base 20 which defines a channel 45 within which the risers 30*a*-30*f* may be stacked and removably disposed. Furthermore, in other embodiments, one or more riser brackets with shapes other than a U-shape, and/or more than two riser brackets that otherwise define a channel 45 within which the risers 30*a*-30*f* can be disposed are contemplated.

Moreover, with reference to FIGS. 1-4, and as described above, the present invention includes a plurality of risers 30*a*-30*f* which can be selectively and removably disposed within the channel 45 or riser bracket(s) 40*a*, 40*b* to define a height-adjustable support block 35. More specifically, the embodiment shown includes six risers 30*a*-30*f* each of which can be disposed within the channel 45 or retained within the bracket(s) 40*a*, 40*b* individually or collectively. For example, in order to create a tall support block 35, all of the risers 30*a*-30*f* can be vertically stacked upon one another within the channel 45 and/or otherwise retained by the riser bracket(s) 40*a*, 40*b*, as shown in FIG. 1.

The risers 30*a*-30*f* are selectively disposable within the riser bracket(s) 40*a*, 40*b* in order to allow a user to selectively remove one or more of the risers 30*a*-30*f* from (or otherwise select not to include one or more of the risers 30*a*-30*f* within) the vertical stack or support block 35. Removal of one or more risers from the stack thereby lowers the height of the support block 35 or otherwise defines a support block 35 having a lower height. More specifically, the user or individual can choose which one or more risers 30*a*-30*f* to use when forming the height-adjustable support block 35 or stack. This allows the user to selectively adjust the height of the support block simply by including or not including one or more of the risers 30*a*-30*f* within the stack.

Figure 5:
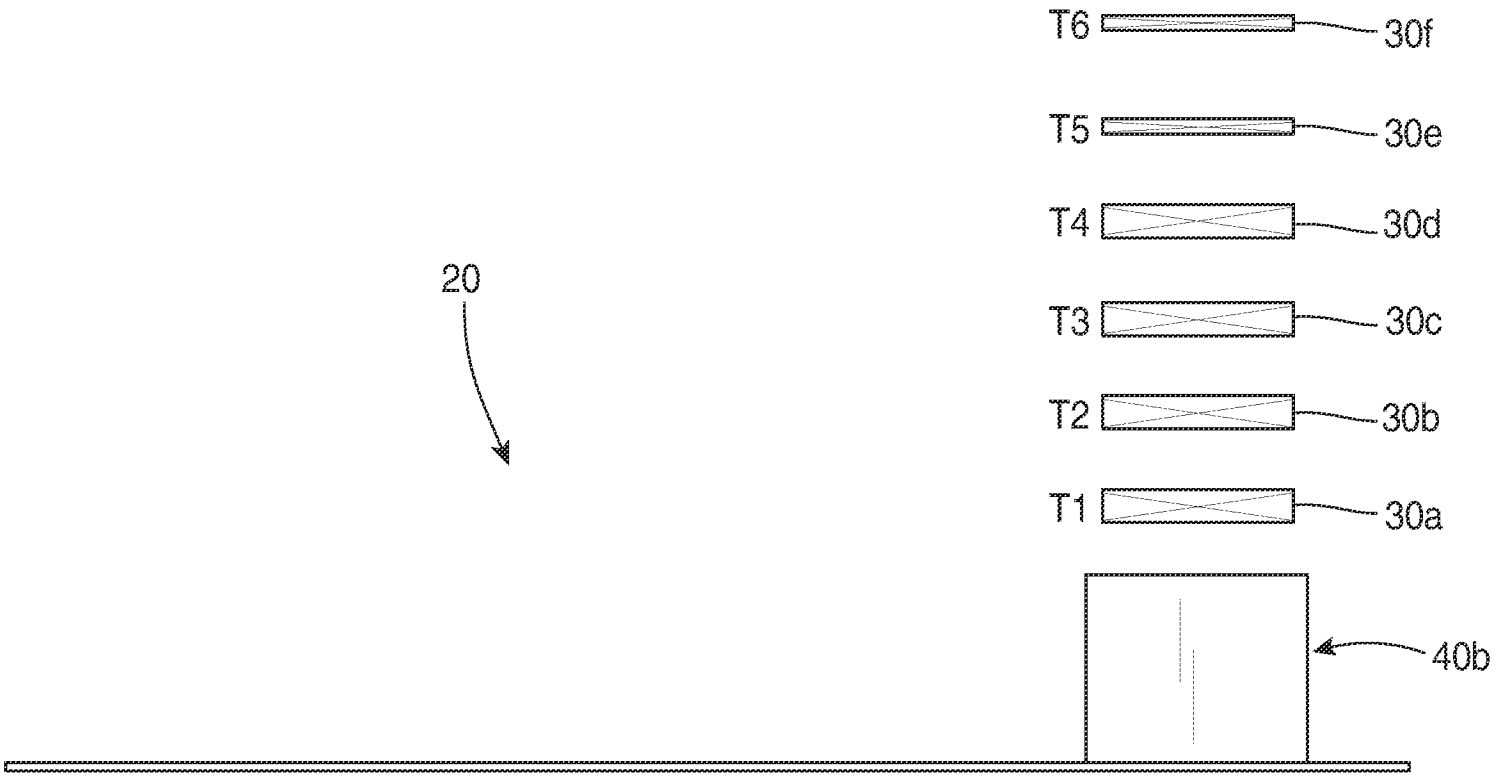
FIG. 5 is an end view of a plurality of risers as disclosed in accordance with at least one embodiment of the present invention.

With reference now to FIG. 5, an end view of a plurality of risers 30*a*-30*f* is shown wherein at least two of the risers 30*a*-30*f* include different thicknesses T1-T6 or different heights. More specifically, in the exemplary embodiment shown, four risers 30*a*, 30*b*, 30*c*, 30*d* include a first but equal or substantially equal thicknesses T1, T2, T3, T4, respectively, and two risers 30*e*, 30*f* include a second but equal or substantially equal thicknesses T5, T6, respectively. In other words, in this exemplary embodiment, thicknesses T1-T4 are the same or substantially the same, and thicknesses T5, T6 are the same or substantially the same, however thicknesses T1-T4 are different than thicknesses T5, T6.

In this example, thicknesses T1-T4 may include ½ inches, whereas thicknesses T5, T6 may include ¼ inches, however, other thicknesses, whether greater or less than ½ inches or greater or less than ¼ inches, are contemplated within the full spirit and scope of the present invention. It should also be noted that other thickness variations between the risers 30*a*-30*f* may be implemented. For example, the risers 30*a*-30*f* may collectively include two, three, four or more different thicknesses there between. In some cases, all of the risers 30*a*-30*f* may have different thicknesses, or all of the risers 30*a*-30*f* may have the same or substantially the same thicknesses.

It should also be noted that while six risers 30*a*-30*f* are shown in the exemplary embodiment illustrated in FIGS. 1-5, other embodiments may include more or fewer risers and still achieve the intended implementation of the present invention.

Accordingly, with reference again to FIG. 3, the activity or exercise assembly 10 of at least one embodiment may be used by an individual 100 standing in an upright or orthostatic position with his/her feet spaced a distance apart from one another and facing forward, for example, toward the front edge 24*a*. The user 100 will then place his/her heels 102 on top of the height-adjustable support block 35. The user 100 will then perform the squat exercise or maneuver by first lowering his/her hips from the initial standing position, and then standing back up, generally without moving the feet throughout the exercise or maneuver. The risers 30*a*-30*f* can be removed systemically or progressively from the stack or block 35 when the individual feels comfortable with the height of the heels during the squat exercise. Removing the riser(s) 30*a*-30*f* from the block 35 will lower the overall or collective height of the block 35. The user or individual 100 will then repeat the squat exercise with his/her heels on the lowered block 35, which can generally be a more challenging exercise than that with a higher block 35. This process of progressively removing the risers 30*a*-30*f* from the height-adjustable support block 35 will continue, as the individual feels comfortable, until all of the risers 30*a*-30*f* have been removed.

In an exemplary embodiment, the risers 30*a*-30*f* can be progressively removed/added to lower the overall height of the block 35 by ¼ inch at a time. However, other adjustments, depending on the thicknesses T1-T6 of the risers 30*a*-30*f*, and the number of risers 30*a*-30*f* included, are contemplated.

In any event, with all of the risers 30*a*-30*f* removed from the height-adjustable support block 35, the individual 100 will then repeat the squat exercise on a flat surface 22 with the heels 102 and entire foot on a flat surface. This is often referred to as a flat-footed squat or a primal squat.

As mentioned above, other exercises, activities or maneuvers can be performed using the activity or exercise assembly 10 of the various embodiments of the present invention. In addition, a number of routines or series of exercises can be performed using the assembly 10 disclosed herein.

Figure 6:
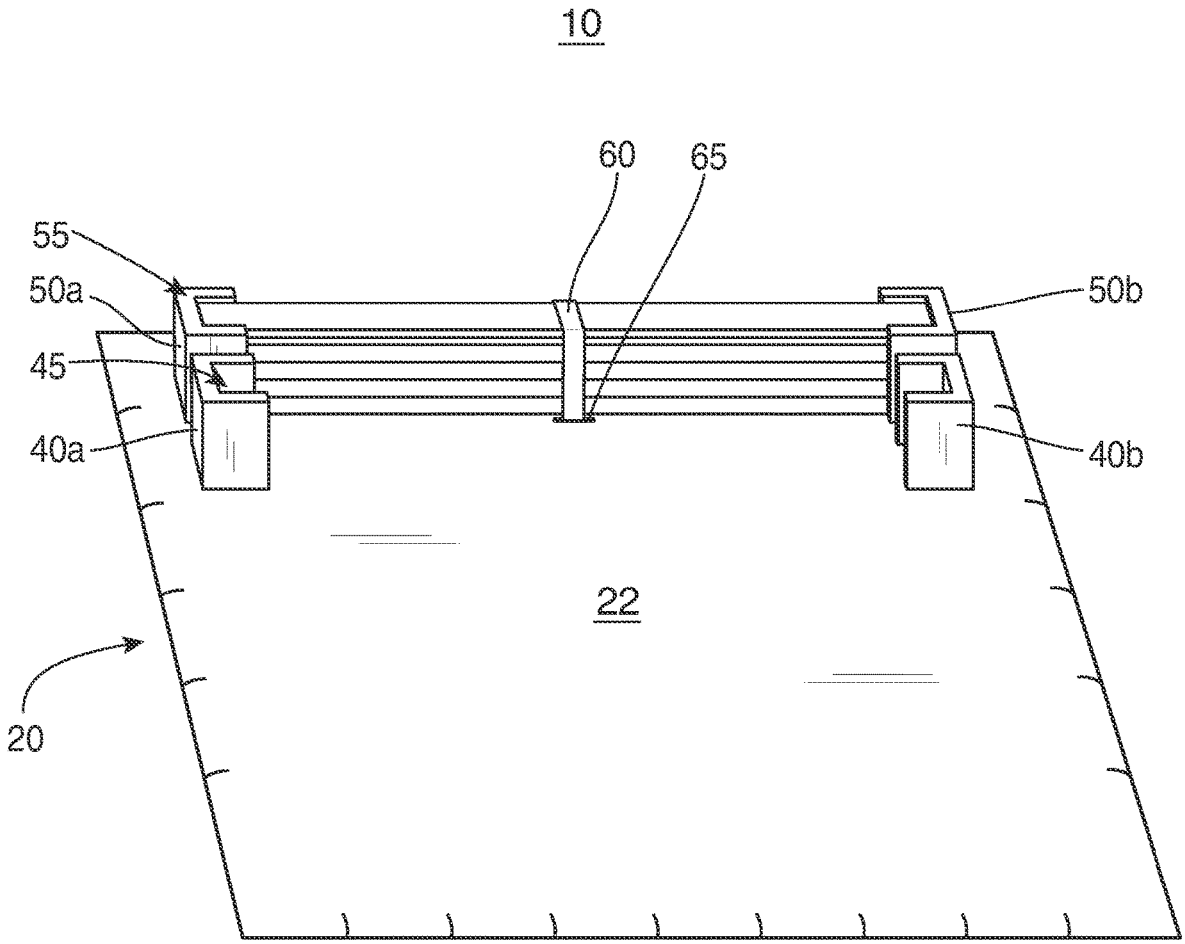
FIG. 6 is front perspective view of another embodiment of the exercise assembly as disclosed herein.
Figure 7:
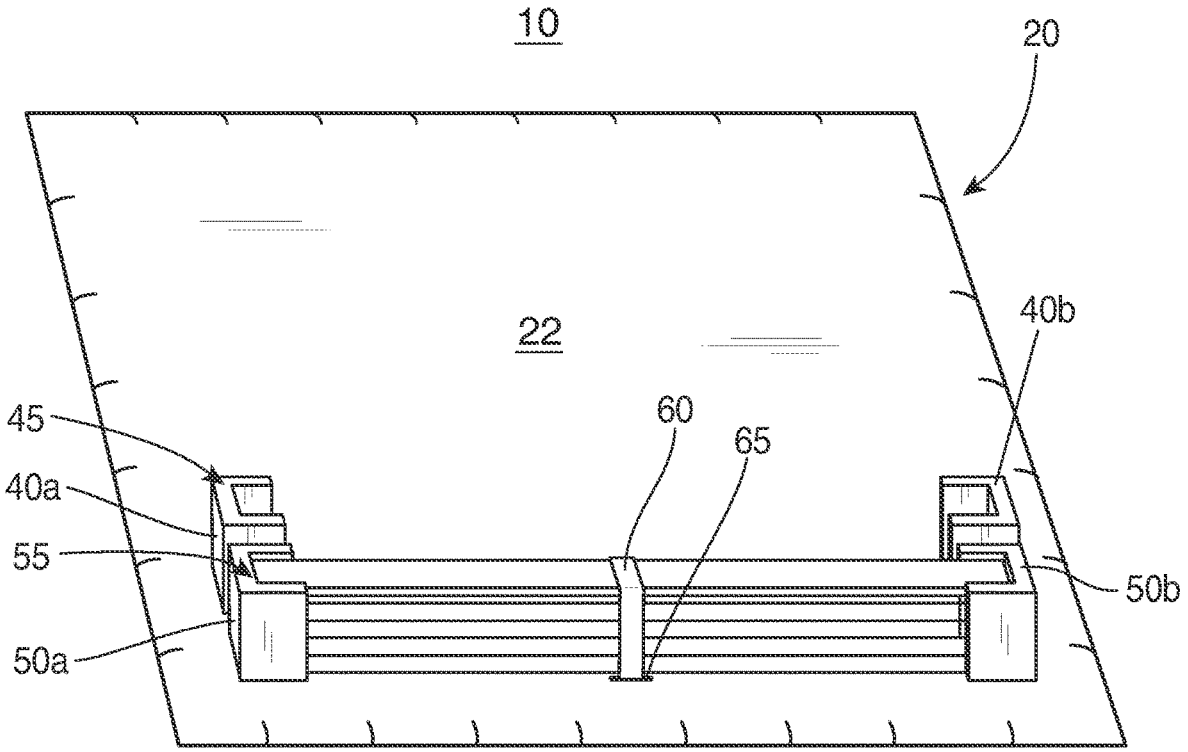
FIG. 7 is a review perspective view of the embodiment illustrated in FIG. 6.

Referring now to FIGS. 6 and 7, another embodiment of the exercise assembly 10 of the present invention is illustrated. Specifically, in this embodiment, at least one storage bracket 50*a*, 50*b* is shown attached or fixed to the top surface 22 of the base 20 or platform. In particular, the storage bracket(s) 50*a*, 50*b* may be used to hold, retain or store the planks or risers 30*a*-30*f* when they are not being used (e.g., after being removed from the riser bracket(s) 40*a*, 40*b*) or when travelling or storing the assembly 10.

For instance, the storage bracket(s) 50*a*, 50*b* may be similar in construction and function to the riser bracket(s) 40*a*, 40*b* and otherwise define a second location where the risers 30*a*-30*f* may be vertically stacked. In the embodiment shown in FIGS. 6 and 7, the storage bracket(s) 50*a*, 50*b* are disposed adjacent to the riser bracket(s) 40*a*, 40*b*, and more specifically, rearward of the riser bracket(s) 40*a*, 40*b* closer to the rear edge 24*b*. Other locations for the storage bracket (s) 50*a*, 50*b* are contemplated within other embodiments.

Moreover, similar to the riser bracket(s) 40*a*, 40*b*, the storage bracket(s) 50*a*, 50*b* define a channel 55 there between and within which the one or more risers 30*a*-30*f* are selectively and removably disposed, as described herein. In some cases, as shown in the exemplary embodiment of FIGS. 6 and 7, the assembly 10 includes two opposing storage brackets, such as a first storage bracket 50*a* and a second storage bracket 50*b*, which collectively define the channel 55 there between. In this manner, the first and second storage brackets 50*a*, 50*b* of at least one embodiment are attached or fixed to the base 20 in a spaced apart manner and each include a U-shaped configuration which define the corresponding ends of the channel 55. For instance, open ends of the U-shaped brackets 50*a*, 50*b* are aligned with one another in a spaced and facing relation to define the ends of channel 55.

Moreover, similar to the riser brackets 40*a*, 40*b*, the storage brackets 50*a*, 50 of at least one embodiment are spaced in a manner such that the channel 55 includes a length that allows the risers 30*a*-30*f* to be disposed therein in a secure, yet removable and vertically stacked manner. For instance, the length of the channel 55 defined by the storage brackets 50*a*, 50*b* may be equal to or slightly longer than the length of each corresponding riser 30*a*-30*f*, thereby allowing the risers 30*a*-30*f* to be removably stacked therein, as shown in exemplary FIGS. 6 and 7.

It should be noted that the channel 55 defined by the storage brackets 50*a*, 50*b* of a least one embodiment includes an elongated shape or configuration in that the length of the channel 55 is longer than the width of the channel 55, however, other shapes and sizes are contemplated within the full spirit and scope of the various embodiments disclosed herein. Accordingly, the various risers 30*a*-30*f* of at least one embodiment include a shape and size that is consistent with or otherwise compatible with the shape of the channel 55 thereby allowing the risers 30*a*-30*f* to be removably disposed therein.

It should also be noted that, in at least one embodiment, the storage bracket(s) 50*a*, 50*b* include an open top face which allows the one or more risers 30*a*-30*f* to be lowered into the channel 45 and vertically stacked therein, as shown and described. Other configurations, shapes and constructions of the storage bracket(s) 50*a*, 50*b* to define a corresponding channel 55 are contemplated herein and are within the full spirit and scope of the present invention. As just an example, a single storage bracket may be formed and secured to the top surface of the base 20 which defines a channel 55 within which the risers 30*a*-30*f* may be stacked and removably disposed. Furthermore, in other embodiments, one or more storage brackets with shapes other than a U-shape, and/or more than two storage brackets that otherwise define a channel 55 within which the risers 30*a*-30*f* can be disposed are contemplated.

In some cases, as shown in the exemplary embodiment of FIGS. 6 and 7, the storage channel 55 may be adjacent and parallel to the riser channel 45, although other locations and orientations of the various brackets 40*a*-*b*, 50*a*-*b* and corresponding channels 45, 55 are contemplated and within the scope of the present invention.

Still referring to the embodiment of FIGS. 6 and 7, a securing device, generally represented at 60 may be included to secure the stacked risers 30*a*-30*f* to the base 20 or platform, particularly, but not limited to, for purposes of transportation or storage of the assembly 10. In particular, the securing device 60 may be selectively disposed into a secured relation with the risers 30*a*-30*f* by being wrapped around the top of the stack as shown, and secured to the base 20. In one embodiment, the securing device 60 may pass through one or more holes, openings or slits 65 in the base 20 and wrap around the bottom of the base 20 (not shown) and on top of the stack of risers 30*a*-30*f*. In some cases, the strap or securing device 60 may wrap around the rear edge 24*b* of the base 20.

In other embodiments, the base 20 may include holes, opening or slits 65 on both sides of the stack or risers 30*a*-30*f* such that the securing device 60 may pass through both of the slits or openings 65, and around the bottom of the base 20 and the top of the stack of risers. In yet another embodiment, the securing device 60 may be fixed to base 20, for instance at least one or both ends on one or both sides of the stack of risers and wrap around to the top of the stack.

In any event, the securing device 60 may include, in at least one embodiment, an elongated flexible strap which can attach to itself via one or more fasteners in order to form a loop or a partial loop that secures the stack of risers 30*a*-30*f* to the base 20. As just an example, the fastener(s) (not shown) may include hook and loop type fasters such as VELCRO, snaps, buttons, clips, clamps, etc.

Other securing device(s) 60 structured and configured to removably secure the one or more risers 30*a*-30*f* to the base 20 is/are contemplated within the full spirit and scope of the present invention. It should also be noted that, the embodiment illustrated in FIGS. 1-5 may include a securing device 60 or strap spanning the riser channel 45 in order to secure or maintain the risers 30*a*-30*f* in the vertically stacked orientation within the riser brackets 40*a*, 40*b*.

Furthermore, as provided above, the top surface 22 of the base 20 or platform of at least one embodiment includes a substantially flat or planar surface upon which a user may stand, as generally shown in FIGS. 1-4 and 6-7. In some embodiments, the base 20 may include a sloped, curved or tapered surface at or near one or more of the edges, such as, the front edge 24*a*, rear edge 24*b*, left edge 24*c* and/or right edge 24*d*. For instance, as shown in FIGS. 6 and 7, the base 20 may include a downwardly sloped, curved, angled or tapered configuration declining from the raised or slightly elevated top surface 22 down toward the ground or bottom surface of the base 20.

Still in further embodiments, the base 20 and/or the top surface 22 thereof may be made of or include a padded or gripping (e.g., anti-slip) layer for comfort and safety of the user thereof. In some cases, the top surface 22 of the base 20 may include indicia, for example, in the form of a grid, markings, outlines of feet, lines, etc. that guide the user on where to place his/her feet during performance of one or more exercises upon the assembly 10.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described.

What is claimed is:

1. An exercise assembly, comprising:

a base platform defining a top surface, at least one riser bracket fixed to said top surface of said base platform, a plurality of elongated risers individually selectively disposable within, and removable from, said at least one riser bracket to define a height-adjustable support block, said height-adjustable support block being disposed on top of said top surface of said base platform, and wherein, through the selective disposition of at least one of said plurality of elongated risers within said at least one riser bracket, said height-adjustable support block comprises a height that extends a selected distance above said top surface of said base platform.

2. The exercise assembly as recited in claim 1 wherein at least two of said plurality of elongated risers comprise different thicknesses.

3. The exercise assembly as recited in claim 1 wherein said at least one riser bracket comprises two opposing riser brackets, each of said two opposing riser brackets comprising open facing ends defining an elongated channel between said two opposing riser brackets, through said open facing ends and along said top surface of said base platform, wherein each of said plurality of elongated risers are selectively and removably disposable within said elongated channel defined by said two opposing riser brackets and said open facing ends.

4. The exercise assembly as recited in claim 3 wherein said two opposing riser brackets each further comprise an open top face.

5. The exercise assembly as recited in claim 4 wherein each of said plurality of elongated risers are selectively lowered into and removably raised from said elongated channel through said open top faces of said two opposing riser brackets.

6. The exercise assembly as recited in claim 5 wherein said base platform comprises a front edge and a rear edge, said front edge being opposite said rear edge, wherein said two opposing riser brackets and said height-adjustable support block are disposed closer to said rear edge than said front edge.

7. The exercise assembly as recited in claim 6 wherein said base platform further comprises a left edge and a right edge, said left edge being opposite said right edge, wherein each of said plurality of elongated risers comprise a length that is less than a width of said base platform, said width of said base platform being measured from said left edge to said right edge.

8. The exercise assembly as recited in claim 7 wherein each of said plurality of elongated risers comprise equal lengths, and wherein at least two of said plurality of elongated risers comprise different thicknesses.

9. The exercise assembly as recited in claim 1 further comprising at least one storage bracket fixed to said top surface of said base platform.

10. The exercise assembly as recited in claim 9 wherein said at least one storage bracket is disposed adjacent said at least one riser bracket.

11. The exercise assembly as recited in claim 9 wherein said at least one storage bracket comprises two opposing storage brackets defining an elongated channel there between within which said plurality of elongated risers are selectively disposable forming a storage stack disposed on top of said top surface of said base platform.

12. The exercise assembly as recited in claim 11 herein said two opposing storage brackets each comprise aligned and facing open ends, and open top faces, wherein each of said plurality of elongated risers can be selectively lowered into and removably raised from said elongated channel defined by said two opposing storage brackets through said open top faces of said two opposing storage brackets.

13. The exercise assembly as recited in claim 12 further comprising at least one securing device disposable in a secured relation to said plurality of elongated risers selectively disposed within said elongated channel of said storage brackets.

14. The exercise assembly as recited in claim 13 wherein said securing device comprise a flexible strap secured between said base platform and said plurality of elongated risers selectively disposed within said elongated channel of said storage brackets.

15. An exercise assembly, comprising:

a base platform defining a top surface, two opposing riser brackets fixed to said top surface of said base platform, said two opposing riser brackets each comprising open facing ends and open top faces, said riser brackets defining a riser channel extending between said two opposing riser brackets, through said open facing ends of said two opposing riser brackets, and along and on top of said top surface of said base platform, two opposing storage brackets fixed to said top surface of said base platform, said two opposing storage brackets each comprising open facing ends and open top faces, said two opposing storage bracket defining a storage channel extending between said two opposing storage brackets, through said open facing ends of said two opposing storage brackets, and along and on top of said top surface of said base platform, and a plurality of risers each selectively and removably disposable between a stored position and an operative position, wherein said stored position is defined as said corresponding riser being selectively and removably disposed within said storage channel of said two opposing storage brackets, and wherein said operative position is defined as said corresponding riser being selectively and removably disposed within said riser channel of said two opposing riser brackets, wherein a height-adjustable support block is defined by at least one of said plurality of risers disposed in said operative position.

16. The exercise assembly as recited in claim 15 wherein each of said plurality of risers comprises the same lengths, and wherein at least two of said plurality of risers comprise different thicknesses.

17. The exercise assembly as recited in claim 15 further comprising a flexible strap removably secured between said base platform and said plurality of risers selectively disposed within said storage channel.

* * * * *